United States Patent [19]

Imazu et al.

[11] Patent Number: 4,541,546

[45] Date of Patent: Sep. 17, 1985

[54] DRAW-IRONED METAL VESSEL HAVING CIRCUMFERENTIAL SIDE SEAM

[75] Inventors: Katsuhiro Imazu, Yokohama; Hiroshi Matsubayashi, Kamakura; Makoto Horiguchi, Fujisawa; Kazuo Taira, Tokyo; Seishichi Kobayashi, Yokohama; Hiroshi Ueno, Yokosuka, all of Japan

[73] Assignee: Toyo Seikan Kaisha, Ltd., Tokyo, Japan

[21] Appl. No.: 686,640

[22] Filed: Jan. 3, 1985

Related U.S. Application Data

[63] Continuation of Ser. No. 443,598, Nov. 22, 1982, abandoned.

[51] Int. Cl.[4] ..... H05B 3/68

[52] U.S. Cl. ..... 220/456; 220/458

[58] Field of Search ..... 220/454–458, 220/75; 413/1, 4, 7, 8, 18, 22

[56] References Cited

U.S. PATENT DOCUMENTS

| | | | |
|---|---|---|---|
| 360,993 | 4/1887 | Brown | 220/DIG. 22 |
| 1,472,616 | 10/1923 | Richman | 413/4 |
| 1,574,973 | 3/1926 | Horvath | 413/4 |
| 2,889,069 | 6/1959 | Fuchs | 220/454 |
| 4,065,023 | 12/1977 | Rentmeester et al. | 413/1 |
| 4,261,193 | 4/1981 | Boils | 72/349 |
| 4,372,459 | 2/1983 | Newman | 413/7 |

*Primary Examiner*—Leon Gilden

*Attorney, Agent, or Firm*—Sherman and Shalloway

[57] ABSTRACT

Disclosed is a draw-ironed metal vessel having a circumferential side seam, which is formed by lap-bonding of open end portions of upper and lower members, each consisting of a seamless molded metal cap, wherein the side wall of at least one of said upper and lower members is formed by draw-ironing a tin-plated steel plate at an ironing ratio of at least 20% and a spout having a diameter smaller than that of the side wall of the vessel is formed on the top wall of the upper member.

4 Claims, 5 Drawing Figures

DRAW-IRONED METAL VESSEL HAVING CIRCUMFERENTIAL SIDE SEAM

This application is a continuation of application Ser. No. 443,598 filed Nov. 22, 1982 abandoned.

BACKGROUND OF THE INVENTION (1) Field of the Invention

The present invention relates to a draw-ironed metal vessel having a circumferential side seam. More particularly, the present invention relates to a novel draw-ironed metal vessel of excellent quality as having the combination of pressure resistance, the light-weight characteristic and the shock resistance.

(2) Description of the Prior Art

So-called draw-ironed cans are widely used for contents having a spontaneous pressure, such as beer and carbonated drinks.

These draw-ironed cans are prepared by draw-forming a metal blank punched in a disc or the like between a drawing punch and a drawing die to form a cup and ironing the side wall of the formed cup between an ironing punch and an ironing die to reduce the thickness of the side wall.

In a draw-ironed can, reduction of the side wall of the vessel is preferred for reducing the weight per unit volume of the can and decreasing the cost of the metal blank necessary for the production of the can.

However, this requirement has not been completely satisfied in the prior art because various limitations are placed on the production of cans. For example, when the thickness of the side of a can body is reduced, the buckling strength should naturally be reduced. When a can end is double-seamed to a can body, the axial load to be applied to the can body by a double seamer is 120 to 200 Kg, and if the thickness of the side wall portion is reduced below a certain limit, double-seaming of a can end becomes difficult.

The structurally weakest portion of a draw-ironed can is the portion double-seamed to a can end, and when the can receives shocks upon falling or the like, this portion may be broken and leakage may be caused in this portion.

SUMMARY OF THE INVENTION

It is a primary object of the present invention to provide a draw-ironed metal vessel of a tin-plated steel plate which is quite different from conventional draw-ironed cans in the structure and vessel characteristics.

Another object of the present invention is to provide a draw-ironed metal vessel of a tin-plated steel plate in which there is not a portion double-seamed to an end and the sole seam present in the vessel is a circumferential side seam formed by lap-bonding of open end portions of two confronting seamless cups.

Still another object of the present invention is to provide a draw-ironed metal vessel of a tin-plated steel plate, which has a smaller thickness of the side wall portion than in the conventional draw-ironed tin-plated steel plate cans and is excellent in the light-weight characteristic, pressure resistance and shock resistance and which can easily be disposed of because of a high case of crushability.

A further object of the present invention is to provide a draw-ironed metal vessel formed by draw-ironing of a tin-plated steel plate, which has a circumferential side seam excellent in the bonding property and in which the adhesion of a coating thereto is high.

More specifically, in accordance with the present invention, there is provided a draw-ironed metal vessel having a circumferential side seam, which is formed by lap-bonding of open end portions of upper and lower members, each consisting of a seamless molded metal cup, wherein the side wall of at least one of said upper and lower members is formed by draw-ironing a tin-plated steel plate at an ironing ratio of at least 20% and a spout having a diameter smaller than that of the side wall of the vessel is formed on the top wall of the upper member.

The present invention will now be described in detail with reference to the accompanying drawings.

DETAILED DESCRIPTION OF THE PREFERRED EMBODIMENTS

Figure 1:
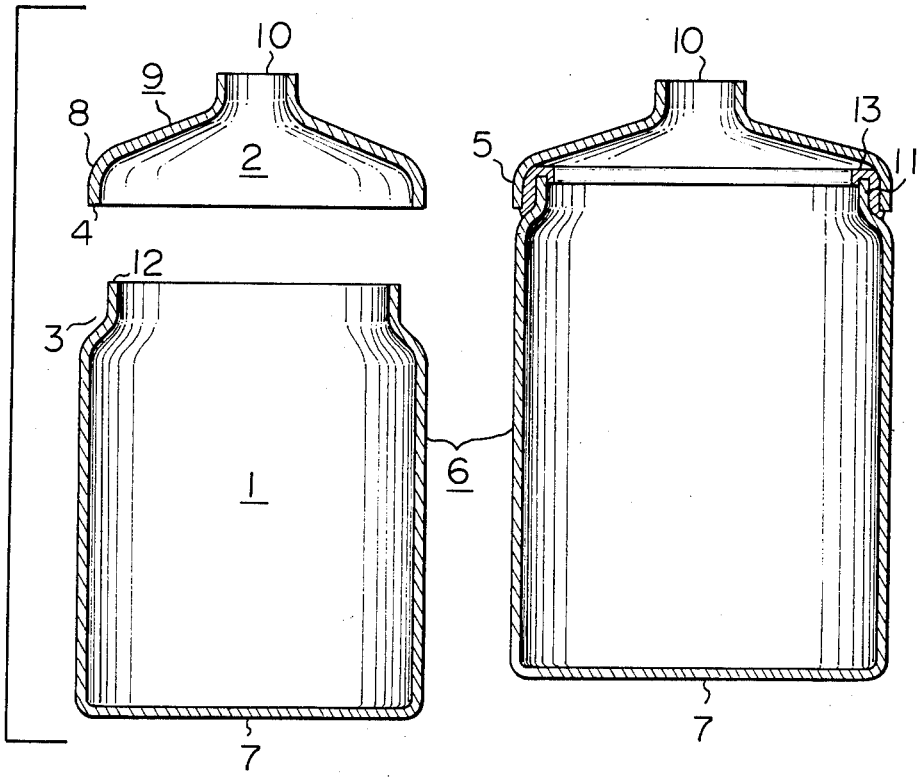
FIG. 1 is a sectional view illustrating a most preferred embodiment of the draw-ironed metal vessel according to the present invention.

Referring to FIG. 1 illustrating a most preferred embodiment of the present invention, a draw-ironed metal vessel comprises a lower member 1 formed of a seamless molded cup of a tin-plated steel plate and an upper member 2 formed of a seamless molded cup of a metal. These molded cups are integrated in the form of a vessel by lap-bonding open end portions 3 and 4 to form a circumferential side seam 5.

In the embodiment illustrated in FIG. 1, the lower member 1 comprises a tall thin side wall portion 6 formed by deeply draw-ironing a tinplate blank and a thick bottom portion 7 which is not substantially ironed. The upper member 2 comprises a short side wall 8 formed by shallow drawing of a tinplate blank and a top wall 9. The height of the side wall portion 8 of the upper member 2 is equal to or slightly larger than the width of the seam 5. The top wall 9 of the upper member 2 has a convex taper face, and a spout 10 for charging and discharging the content is formed at the center of the top wall 9. As is apparent from the foregoing description, the upper member 2 is bonded in the form of a shoulder and neck of a so-called bottle to the lower member 1.

In the embodiment shown in FIG. 1, the open end portion 3 of the lower member 1 is drawn by necking-in of the adjoining portion so that the diameter is smaller than that of the other barrel wall portion, and the open end portion 3 is fitted and inserted in an open end portion 4 of the upper member 2 having a larger diameter.

An adhesive layer 11 is formed between the outer surface of the open end portion 3 of the lower member and the inner surface of the open end portion 4 of the upper member to effect bonding and integration of the upper and lower members. From the viewpoint of corrosion resistance, it is preferred that a part of the adhesive 11 protrude from the seam 5 to form a coating layer 13 for a cut edge 12 of the tinplate blank located on the inner side of the seam.

In the present invention, the side wall 6 of the lower member constituting a main part of the barrel portion of the vessel is ironed so that the ironing ratio $R_I$ defined by the following formula:

$$R_I = \frac{T_B - T_W}{T_B} \times 100$$

wherein $T_B$ stands for the thickness of the bottom of the molded cup $T_W$ stands for the thickness of the side wall of the molded cup, is at least 20%, preferably 30 to 80%.

The tinplate vessel of the present invention is characterized in that, as pointed out hereinbefore, the side wall constituting a main part of the barrel portion of the vessel is highly ironed and the thickness is reduced, the sole seam present in the vessel is a circumferential side seam, and this seam is formed by lap bonding.

More specifically, in the tinplate vessel of the present invention, a double seam portion does not exist and the spout is sealed by a cap or plug. Accordingly, even in the case where the thickness of the side wall of the vessel is extremely reduced, the buckling tendency is obviated at the sealing step. At the commercial capping operation, the axial load applied to the vessel barrel is in the range of 50 to 100 Kg and is smaller than about ½ of the axial load applied at the double-seaming step. Therefore, the buckling tendency is considerably reduced as compared with the case of double seaming.

Furthermore, the circumferential side seam present in the tinplate vessel of the present invention is formed by lap bonding having a high resistance against a load applied in the axial direction. Accordingly, the structure of the vessel of the present invention is highly resistant to pressures or shocks. In case of double seaming, bonding by folding (lock seaming) or butt bonding, if the thickness of the blank is small, the blank constituting the seam is first deformed by the load applied to the seam, and because of this deformation, leakage at the seam or breakage of the seam is caused under a relatively small load. In contrast, in case of lap bonding, even if the thickness of the blank constituting the seam is small, the above-mentioned deformation of the blank is not caused, and the seam can resist a force of up to a shear strength of the seam, which is unrelated to the thickness of the blank.

Moreover, since the thickness of the main portion of the barrel of the tinplate vessel is reduced by high ironing, the weight of the vessel per unit volume is drastically reduced and the material metal cost can be lowered. Further, in the barrel portion of the vessel of the present invention, a fresh metal face is exposed to the outside by high ironing, and therefore, adhesion to a protecting paint and adhesion to an adhesive used for formation of a seam are highly enhanced. This is another advantage attained by the present invention.

As the tinplate blank for formation of the vessel of the present invention, tinplate having tin deposited in an amount of 0.1 to 1.0 l b/B.B. on one surface is preferably used. The deposited tin layer may be one subjected to a remelting treatment (reflow plate or bright plate), or it may not be subjected to this treatment (non-reflow plate or matt plate).

Among various metal blanks, a tinplate blank is relatively difficult to bond by an adhesive. In a tinplate blank, a tin oxide layer should naturally be formed in the surface portion of the deposited tin layer. This tin oxide layer is poor in mechanical strength and is brittle. Accordingly, it is believed that in a vessel formed by bonding such tinplate by an adhesive, the tin oxide layer present in the bonding interface is readily peeled, resulting in drastic reduction of the bonding strength. In contrast, in the present invention, since the side wall portion of the upper or lower member, to be formed into a circumferential seam, is subjected to a drawing processing or a high ironing processing, peeling of the tin oxide layer and exposure of a fresh metal surface are effected, and therefore, the adhesion or bonding property to an adhesive or primer is highly improved.

For formation of a draw-ironed cup, a tinplate blank such as mentioned above is punched into a disc or the like and is subjected to one-stage or multi-stage drawing between a drawing punch and a drawing die, and multi-stage ironing is carried out between an ironing punch and an ironing die. Drawing and ironing conditions are known, and drawing and ironing can be accomplished very easily according to known procedures while controlling the ironing ratio in the above-mentioned range.

It is preferred that the thickness of the tinplate blank to be processed be 0.2 to 0.5 mm, especially 0.2 to 0.35 mm, though the preferred thickness is varied more or less according to the size of the final vessel, and it also is preferred that the thickness $T_W$ of the side wall portion formed by ironing be 0.05 to 0.20 mm, especially 0.06 to 0.17 mm, while the ironing ratio is in the above-mentioned range.

If the ironing ratio of the open end portion of the cup to be subjected to a necking-in treatment is lower by 5 to 30% than the ironing ratio of the other side wall portion, this portion is advantageously prevented from being damaged at the necking step. For this purpose, there may be adopted a method in which the ironing operation is performed in at least three stages while gradually narrowing the clearance between a punch and a die and the open end portion is prevented from being ironed at the ironing step of the final stage.

The operation of necking-in the draw-ironed cup is carried out so that the upper and lower members come to have such sizes that they are precisely fitted together. In the present invention, if (1) the outer diameter $r_I$ of the open end portion which is to be located on the inner side of the circumferential lap bonding which is to be formed, (2) the inner diameter $r_O$ of the other open end portion which is to be located on the outer side of the circumferential lap bonding and (3) the thickness $d_A$ of the adhesive layer which to be interposed between both the open end portions, are all selected so that the relation of $r_O - r_I < d_A$ is established, both the open end portions will always press the adhesive layer and tight bonding and assured sealing at the seam become possible.

The draw-ironed molded cup is subjected to trimming and after washing if necessary, the cup is subjected to a surface chemical treatment with a phosphate and/or a chromate. Then, an anti-corrosive protecting varnish is applied to at least the inner surface of the cup. The phosphate and/or chromate treatment may be such that P and/or Cr is deposited in an amount of 1 to 20 $mg/m^2$ as the atom on the surface of the deposited tin layer. In the present invention, by this surface chemical treatment of the draw-ironed molded cup, the edge of the open end portion of the cup should naturally be treated, and even if this open end portion is located on the inner side of the seam and exposed to the packed content, it shows a high corrosion resistance. Moreover, the adhesion to an adhesive is improved and also the adhesion of a paint or resin coating to be applied later is improved.

As the protecting varnish, there can be used optional paints comprising thermosetting and thermoplastic resins, for example, modified epoxy paints such as phenol-epoxy paints and amino-epoxy paints, vinyl and modified vinyl paints such as vinyl chloride/vinyl acetate copolymer paints, saponified vinyl chloride/vinyl acetate copolymer paints, vinyl chloride/vinyl acetate/-maleic anhydride copolymer paints, epoxy-modified epoxyamino-modified vinyl resin paints and epoxy-modified epoxyphenol-modified vinyl resin paints, acrylic resin paints, and synthetic rubber paints such as styrene-butadiene copolymer paints.

These paints are applied in the form of an organic solvent solution such as a lacquer or enamel or an aqueous dispersion or solution by spray coating, dip coating, electrostatic coating or electrophoretic coating. Of course, when a thermosetting resin paint is used, the coating is baked according to need.

The shallowly drawn cup of the upper member is formed by shallowly drawing a metal blank, to which a varnish as mentioned above has been applied in advance, by using a pressing mold or a combination of a drawing punch and a drawing die. Then, the top wall of the formed cup is punched to form an upper member having a pouring mouth.

Lap bonding of the upper and lower members is advantageously accomplished by using an adhesive. At this bonding step, an adhesive is applied to at least one of the open end portions of the lower and upper members to be bonded and both the open end portions are fitted together.

Any of adhesives composed of a heat-fusion-bondable thermoplastic resin can optionally be used as the adhesive in the present invention. An adhesive resin having a melting or softening point of 130° to 240° C. is especially preferred. As preferred examples of the adhesive, there can be mentioned nylon type adhesives such as nylon-13, nylon-12, nylon-11, nylon-6,12 and copolyamides and blends thereof, polyester adhesives such as polyethylene terephthalate/isophthalate and polytetramethylene terephthalate/isophthalate, and olefin adhesives such as an acid-modified olefin resin, an ethylene/acrylic acid ester copolymer, an ion-cross-linked olefin copolymer (ionomer) and an ethylene/vinyl acetate copolymer.

The adhesive is applied in the form of a film, powder, dispersion or solution to each of the open end portions to be bonded to form a heat-bondable adhesive layer uniformly along the entire circumference of the open end portion.

When both the upper and lower members are fitted together, the open end portion to be located on the outer side of the seam is heated to increase the diameter or the open end portion to be located on the inner side of the seam is cooled to diminish the diameter, whereby the fitting of both the members is facilitated. If this means is adopted, the fitting can easily be accomplished even when the relation represented by the above-mentioned inequality is established among the outer diameter of the inner end edge, the inner diameter of the outer end edge and the thickness of the adhesive layer.

After the fitting operation, the seam is heated to fuse the adhesive layer, and the seam is cooled to effect bonding and sealing on the seam. Since the adhesive layer is fused at this step in the state where the adhesive layer is pressed in both the end edge portions, bonding and sealing on the seam can be accomplished completely. Heating of the seam is advantageously performed by high frequency induction heating.

In the metal vessel of the present invention, various modifications may be made to the foregoing embodiment.

Figure 2:
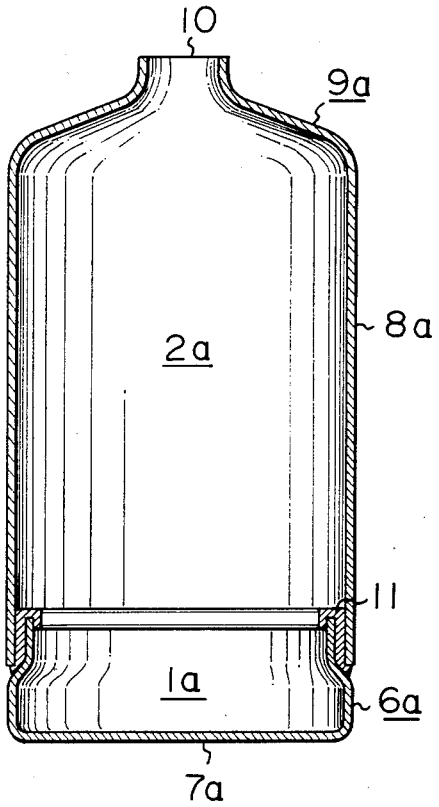
FIG. 2 is a view illustrating an embodiment of the draw-ironed metal vessel according to the present invention, in which the upper member is draw-ironed.

For example, although the side wall portion of the lower member is highly drawn in the foregoing embodiment, there may be adopted a modification shown in FIG. 2 in which the upper member 2*a* is a draw-ironed cup comprising a tall thin side wall portion 8*a* formed by highly draw-ironing a metal blank and a thick top wall 9*a* which is not substantially ironed and the lower member 1*a* is a shallowly drawn cup comprising a short side wall 6*a* formed by shallowly drawing a metal blank and a bottom wall 7*a*.

Figure 3:
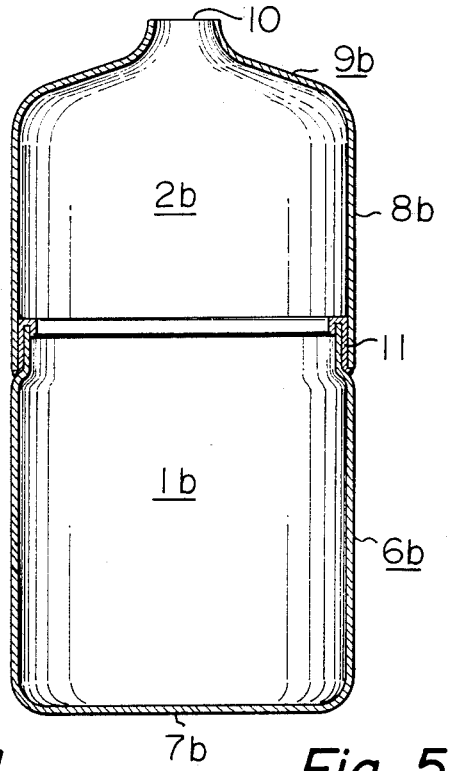
FIG. 3 is a view illustrating an embodiment of the draw-ironed metal vessel according to the present invention, in which both the upper and lower members are draw-ironed.

Furthermore, there may be adopted an embodiment shown in FIG. 3 in which the lower member 1 is a draw-ironed cup as shown in FIGS. 1 and 2, the upper member 2*b* is a draw-ironed cup comprising a tall thin side wall portion 8*b* formed by highly draw-ironing a metal blank and a thick top wall 9*b* which is not substantially ironed, and the open end portions of both the draw-ironed cups are lap-bonded. According to this embodiment, there is provided a tall metal vessel in which the thickness of the entire side wall portion is reduced by ironing of a high ratio.

Figure 4:
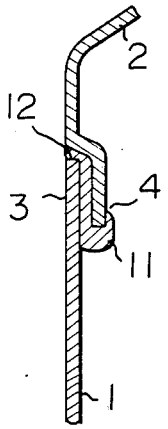
FIGS. 4 and 5 are enlarged partial sectional views illustrating other preferred embodiments of the draw-ironed metal vessel according to the present invention.
Figure 5:
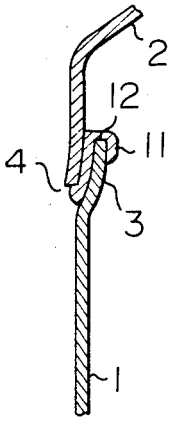

Although the lower open end portion of the upper member is located on the outer side of the seam and the upper open end portion of the lower member is located on the inner side of the seam in the foregoing embodiments shown in FIGS. 1 through 3, there may be adopted a modification shown in FIG. 4 in which the lower open end portion 4 of the upper member 2 is located on the inner side of the seam and the upper end portion 3 of the lower member 1 is located on the outer side of the seam.

The vessel of the present invention is valuable as a vessel for contents having a spontaneous pressure such as a carbonated drink, beer or blown liquor or as an inner pressure vessel in which contents are packed together with nitrogen gas or liquefied nitrogen.

The vessel of the present invention is advantageous over a similar can formed of aluminum in that the rigidity is high and the vessel is excellent in the shape-retaining property and deformation resistance.

The present invention will now be described in detail with reference to the following Examples that by no means limit the scope of the invention.

EXAMPLE 1

A bright tinplate (temper of T-2; tin coating weight of #50/50) having a thickness of 0.30 mm was punched into a disc having a diameter of 120 mm, and the disc was formed into a cup having an inner diameter of 85 mm between a drawing punch and a drawing die according to customary procedures.

The cup was subjected to re-drawing and was then ironed at an ironing ratio of 65.0% by an ironing punch having a diameter of 65.3 mm and an ironing die.

Then, the so-formed lower member was subjected to panelling and necking-in by using known means. The dimensions and physical values of the lower member were as follows.

Thickness $T_B$ of bottom: 0.30 mm
Thickness $T_W$ of side wall: 0.105 mm
$R_I$ value: 65%
Inner diameter of side wall: 65.3 mm
Outer diameter of side wall: 65.51 mm
Height of lower member: 110 mm
Outer diameter of neck portion: 64.95 mm The inner and outer surfaces of the resulting lower member were degreased and washed, and the lower member was subjected to a phosphate treatment (4 $mg/m^2$ of P as the atom was deposited on the tin-plated surface). Then, a white coat composed of a modified acrylic resin was applied to the outer surface of the lower member except an area of a width of about 5 mm from the open end portion, and the outer surface of the lower member was printed. Then, an epoxy ester type finish varnish was applied to the entire outer surface inclusive of the open end portion and was baked. Then, an epoxy urea type paint was applied to the inner surface of the lower member and was baked.

Then, a thermoplastic organic adhesive was applied to a circumferential portion having a width of about 5 mm from the open end portion in the lower member according to customary procedures.

Separately, a bright tinplate (temper of T-1; tin coating weight of #50/50) having a thickness of 0.23 mm, on both the surfaces of which an epoxy ester type paint had been coated and baked in advance, was punched into a disc having a diameter of 90 mm and was then press-formed according to customary procedures. Finally, a liquid-spout was formed on the resulting upper member.

The upper member was fitted with the lower member to which the adhesive had been applied in the circumferential form, and they were heated at about 220° C. to fuse the adhesive and were then cooled to effect bonding and form a metal vessel.

The dimensions and physical values of the metal vessel comprising the upper and lower members were as follows.

Height of vessel: 128–129 mm
Outer diameter of lower member: 65.51 mm
Outer diameter of upper member: 65.49 mm
Length of fitted portion: 5–6 mm
Weight of vessel: 39–40 g The metal vessel was cold-packed with (A) cola, (B) beer or (C) artificial carbonated drink, and the spout was sealed. Then, the packed vessel was heat-sterilized under conditions shown in Table 1.

TABLE 1

| Content | Sterilizing Apparatus | Temperature (°C.) | Spontaneous Pressure ($Kg/cm^2$) |
|---|---|---|---|
| (A) | can warmer | 42 | 7.0 |
| (B) | pasteurizer | 62 | 6.2 |
| (C) | can warmer | 42 | 8.0 |

In each of these three packed vessels, peeling or leakage in the circumferential seam was not caused during the above-mentioned treatment.

These packed vessels were contained in a carbon case (30 can/case) and were subjected to the vibration test and drop test, deformation, breakage or leakage in the bonded portion between the upper and lower member was not observed at all.

EXAMPLE 2

A draw-ironed metal vessel having a circumferential side seam was prepared in the same manner as described in Example 1 except that a bright tinplate having a thickness of 0.27 mm was used and the ironing ratio $R_I$ of the side wall portion of the lower member was changed to 72.2%.

EXAMPLE 3

A draw-ironed metal vessel was prepared in the same manner as described in Example 2 except that a bright tinplate having a thickness of 0.20 mm was used and the ironing ratio $R_I$ of the side wall portion of the lower member was changed to 75%.

COMPARATIVE EXAMPLES 1 THROUGH 3

In Comparative Example 1, a metal vessel was prepared in the same manner as described in Example 1 except that a drawn lower member was formed by subjecting a bright tin-deposited steel plate (temper of T-2; tin coating weight of #50/50) having a thickness of 0.20 mm to drawing and re-drawing according to customary procedures.

In Comparative Examples 2 and 3, drawn lower members were prepared in the same manner as described above except that the blank thickness was changed to 0.10 mm and 0.075 mm, respectively.

In the same manner as described in Example 1, these three comparative metal vessels were packed with the content and sterilized under the conditions shown in Table 1. In all of these three metal vessels, peeling and leakage in the circumferential seam were caused during the treatment.

When these metal vessels were subjected to the vibration test and falling test, deformation or breakage of the bonded portion between the upper and lower members was caused and leakage was observed.

The buckling strength, hardness and bonding strength were determined with respect to each of the metal vessels obtained in Examples 1 through 3 and Comparative Examples 1 through 3. The obtained results are shown in Table 2.

COMPARATIVE EXAMPLE 4

A metal vessel was prepared in the same manner as described in Example 1 except that the phosphate treatment was not carried out. The bonding strength of the metal vessel was measured. The obtained results are shown in Table 2.

TABLE 2

| | Lower Member | Thickness (mm) of Side Wall | Buckling Strength (Kg) | Hardness (Hr 30T) | Bonding Strength (Kg/cm) |
|---|---|---|---|---|---|
| Example 1 | ironed | 0.105 | 250 | 85–88 | 4.3 |
| Example 2 | ironed | 0.075 | 180 | 87–90 | 3.6 |
| Example 3 | ironed | 0.050 | 120 | 87–90 | 2.4 |
| Comparative Example 1 | drawn | 0.200 | 240 | 70–72 | 0.8 |
| Comparative Example 2 | drawn | 0.100 | 140 | 69–72 | 0.4 |
| Comparative Example 3 | drawn | 0.075 | 60 | 70–71 | 0.1 |
| Comparative Example 4 | ironed | 0.105 | 250 | 85–88 | 1.3 |

From the results shown in Table 2, it will readily be understood that the metal vessels of Examples 1 through 3 prepared by ironing the lower member and fitting it with the upper member according to the present invention were improved over the metal vessels of Comparative Examples 1 through 3 prepared according to the conventional draw-forming method in the buckling strength and the bonding strength of the bonded portion, though the thickness of the side wall in the vessels of the present invention was smaller than in the comparative vessels.

EXAMPLE 4

Metal vessels were prepared in the same manner as described in Example 1 except that the ironing ratio $R_I$ of the lower member, represented by the following formula:

$$R_I = \frac{T_B - T_W}{T_B} \times 100$$

was set at 5 points in the range of from 10 to 80% and the $T_B$ value was adjusted so that the $T_W$ value was finally equal.

The buckling strength and the bonding strength were determined with respect to each of the so-obtained five metal vessels. The obtained results are shown in Table 3.

TABLE 3

| Ironing Ratio (%) of Lower Member | Buckling Strength (Kg) | Tensile Strength (Kg/cm$^2$) | Bonding Strength (kg/cm) |
|---|---|---|---|
| 80 | 270 | 74 | 4.7 |
| 60 | 230 | 68 | 4.0 |
| 40 | 210 | 55 | 3.6 |
| 20 | 180 | 47 | 3.1 |
| 10 | 150 | 45 | 0.9 |

From the results shown in Table 3, it will readily be understood that if the lower member is ironed according to the present invention, the buckling strength and bonding strength are remarkably improved.

What is claimed is:

1. In a draw-ironed metal vessel having a circumferential side seam, which is formed by lap-bonding of open end portions of upper and lower members by means of an adhesive, each consisting of a seamless molded metal cup, an improvement which comprises:

(a) the lower member comprising a tall thin side wall portion and a thick bottom portion, said lower member being formed by draw-ironing a tin-plated steel plate at an ironing ration ($R_I$) of at least 20%, said ironing ration ($R_I$) being defined by the following formula:

$$R_I = \frac{T_B - T_W}{T_B} \times 100$$

wherein $T_B$ is the thickness of the bottom portion of the lower member and $T_W$ is the thickness of the sidewall portion of the lower member, said lower member being subjected to a surface treatment with a phosphate and/or a chromate and having a protecting varnish on the entire surface thereof;

(b) The upper member comprising a short side wall, a top wall and a spout having a diameter smaller than that of the side wall, said upper member being formed by shallow drawing of a protecting varnish-coated tin-plated steel plate; and (c) a heat-melt-bondable resin adhesive interposed between the open end portions of the upper and lower members.

2. A metal vessel as set forth in claim 1, wherein the open end portion of the lower member is located on the inner side of the circumferential side seam.

3. A metal vessel as set forth in claim 2, wherein the open end portion of said upper member is subjected to a necking-in processing so that the diameter thereof is smaller than that of the side portion thereof.

4. A metal vessel as set forth in claim 1, wherein the ironing ratio ($R_I$) is in the range of from 30% to 80%.

* * * * *